United States Patent [19]

Anderson et al.

[11] 3,930,368

[45] Jan. 6, 1976

[54] COMBUSTION LINER AIR VALVE

[75] Inventors: Robert D. Anderson; Daniel W. Hyden, both of Indianapolis, Ind.

[73] Assignee: General Motors Corporation, Detroit, Mich.

[22] Filed: Dec. 12, 1974

[21] Appl. No.: 531,875

[52] U.S. Cl. ..... 60/39.23; 60/39.65; 60/39.71

[51] Int. Cl.[2] ..... F02C 9/14

[58] Field of Search ..... 60/39.23, 39.27, 39.29, 60/39.65

[56] References Cited

UNITED STATES PATENTS

| | | | |
|---|---|---|---|
| 2,164,954 | 7/1939 | Stephens | 60/39.65 |
| 2,508,288 | 5/1950 | Owner | 60/39.23 |
| 2,684,573 | 7/1954 | Marskell | 60/39.23 |
| 2,756,040 | 7/1956 | Golden | 60/39.65 X |
| 2,861,419 | 11/1958 | Hausmann | 60/39.23 X |
| 3,577,878 | 5/1971 | Greenwood | 60/39.23 X |
| 3,765,171 | 10/1973 | Hagen | 60/39.23 |
| 3,859,787 | 1/1975 | Anderson | 60/39.65 X |

FOREIGN PATENTS OR APPLICATIONS

| | | | |
|---|---|---|---|
| 639,327 | 4/1962 | Canada | 60/39.29 |

*Primary Examiner*—Clarence R. Gordon
*Attorney, Agent, or Firm*—Paul Fitzpatrick

[57] ABSTRACT

A combustion liner suitable for an automotive gas turbine has variable primary and secondary air admission ports through the wall of the liner. The areas of these sets of ports are varied jointly by two annular valve sleeve assemblies reciprocable on the surface of the liner. Each valve sleeve assembly comprises an outer rigid ring, four approximately quarter-cylindrical valve plates extending around the outer surface of the liner within the ring and coupled to the ring for reciprocation by it, and a leaf spring disposed between the ring and each valve plate to hold the valve plate in contact with the liner.

5 Claims, 7 Drawing Figures

COMBUSTION LINER AIR VALVE

Our invention is directed to valve arrangements suitable for controlling the flow of hot gas, and particularly to such a valve arrangement suited for use in the environment of a gas turbine combustion apparatus. In order to promote clean combustion in such apparatus, it may be necessary to vary the area of the ports through which primary (combustion) air and secondary (dilution) air enter the combustion liner.

Control of the air flow through rings of ports extending through the liner wall by sleeves slidable longitudinally of the wall to uncover the ports to a variable extent has previously been proposed. There are problems in such installations, however. Because of relative thermal expansion and of the need for easy sliding motion of the sleeves on the liner wall, it has been customary in the past to provide an appreciable clearance between the liner wall and the flow regulating sleeve. This militates against accurate control of the flow which requires minimization of flow other than through the uncovered port area. With loosely fitting parts, there is considerable leakage flow which it is difficult to make allowances for.

Our invention is directed to improved valve means and particularly to a movable sleeve assembly which is so constructed as the flow controlling parts of the movable sleeve are composed of several sections distributed around the circumference of the liner. These sections, which are of relatively light and flexible sheet metal, are biased into contact with the liner with relatively light pressure by springs reacting against an actuating ring overlying the valve plates and springs. The ring is coupled to the other parts of the assembly so that these move axially with the ring, and the rings are in turn coupled to some external valve controlling device.

The principal objects of our invention are to improve the operation of valves for variably regulating flow of hot gases such as heated compressed air or other hot gases; to provide a valve defined by two concentric relatively movable parts in which the parts have substantially zero clearance but are free to move notwithstanding differential thermal expansion, warping, or other factors which might cause trouble in a conventional sleeve valve; to provide a sleeve valve defined by inner and outer relatively movable members in which one member is expansible and is biased toward the other member resiliently; and to provide improved flow regulating means adapted to use in a gas turbine combustion apparatus.

The nature of the invention and its advantages will be clear to those skilled in the art from the succeeding detailed description of the preferred embodiment of the invention, the accompanying drawings thereof, and the appended claims.

Referring to the drawings.

Figure 1:
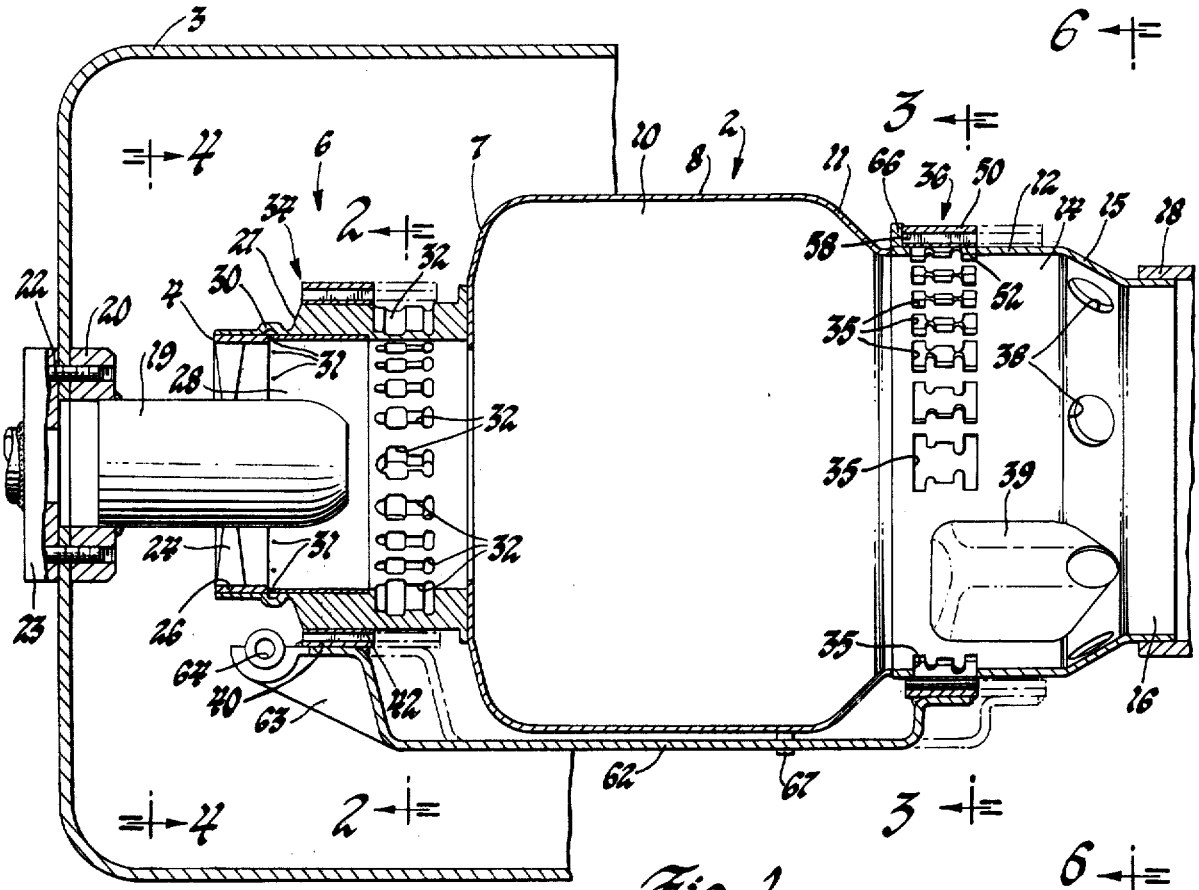
FIG. 1 is a longitudinal sectional view of a gas turbine combustion liner with the installation in an engine illustrated fragmentarily.

Referring to the drawings, a combustion liner 2 is illustrated as installed in a combustion apparatus of a gas turbine engine, the combustion apparatus being enclosed in a housing a portion of which is shown as 3, this housing forming part of an enclosure to which hot air is supplied to support combustion of fuel. The liner 2 and housing 3 may form part of a gas turbine engine such as those described in U.S. Pats. to Collman et al., No. 3,077,074, Feb. 12, 1963; Collman et al., No. 3,267,674, Aug. 23, 1966; and Bell, No. 3,490,746, Jan. 20, 1970.

The liner 2 bears a considerable resemblance in many ways to the liner fully described in a copending patent application of Anderson and Troth for Combustion Apparatus, Ser. No. 439,648, filed Feb. 4, 1974 now Pat. No. 3,859,787, Jan. 14, 1975. The differences, so far as the subject matter of this application are concerned, lie primarily in the means for regulating the flow of air into the combustion liner through circumferentially extending rows of primary and secondary air ports.

The liner 2 is preferably of circular cross-section. The annular walls of the liner define, in sequence from the upstream end of the liner at 4, a premix-prevaporization zone or prechamber 6 for introduction and intimate mixing of fuel and combustion air; an abruptly diverging wall section 7; a substantially cylindrical wall section 8 bounding a reaction zone or combustion zone 10; a converging wall section 11; a generally cylindrical section 12 defining the initial portion of a dilution zone 14; a further converging section 15; and an outlet ring 16. The outlet ring is slidably mounted within the entrance of a scroll or duct 18 which carries the combustion products to a turbine (not illustrated). The upstream end of the liner is supported by a fuel nozzle housing 19 which is welded to a mounting ring 20 fixed to the wall of housing 3 by cap screws 22 which clamp it to an external fuel introduction fitting 23. A suitable pilot fuel nozzle and igniter (not illustrated) may be mounted within the housing 19 and supplied through the fitting 23.

Figure 4:
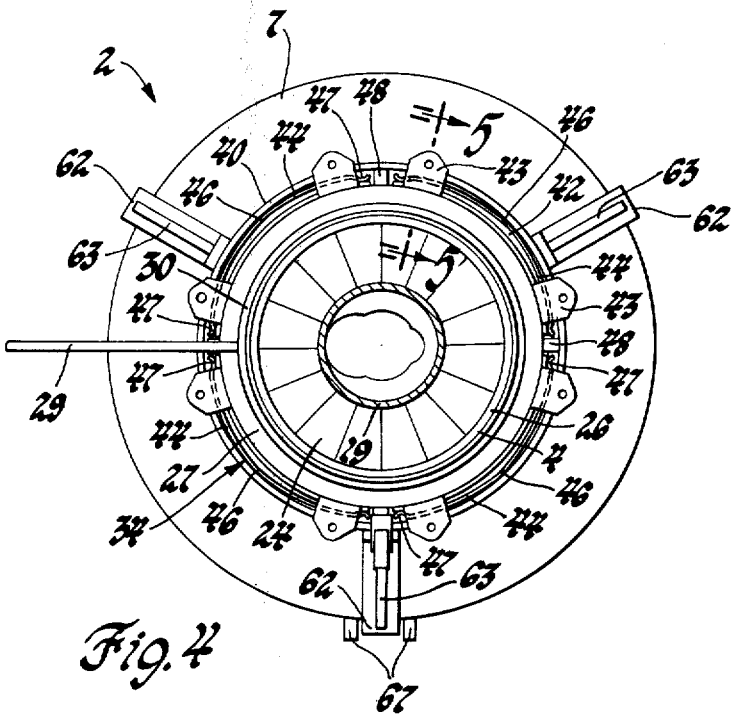
FIG. 4 is an end elevation view taken on the plane indicated by the line 4—4 in FIG. 1.

The nozzle housing 19 is connected by radial swirler vanes 24 defining an axial-flow air inlet at the upstream end of the liner to a ring or shroud 26. Ring 26 is brazed or otherwise fixedly mounted within a machined premix chamber wall 27. A portion of wall 27 is lined by a sheet metal liner 28, the forward edge of which abuts the downstream edge of shroud 26. Liner 28 is of less thickness than shroud 26 so that there is a slight drop or shoulder at the downstream edge of shroud 26. Fuel supplied through a pipe 29 (FIG. 4) is introduced at this point from a manifold 30 defined by a circumferential recess in wall 27. This fuel is laid on the interior of liner 28 through a ring of sixteen small ports, approximately 3/10 millimeter in diameter in the particular example. The swirling air discharged from the cascade of vanes 24 pulls the fuel along the inner surface of ring 28 and evaporates it off the ring. The inner surface of ring 28 is textured or somewhat roughened as described in the above-mentioned patent application.

The major part of prechamber wall 27 is of considerable thickness. Near the downstream end of the prechamber, additional primary air is introduced through a ring of ports 32 machined in the wall. As appears clearly in FIG. 2, these ports are inclined at about a 30° angle to the radial direction so as to introduce the additional primary air with swirl of the same hand as that entering at 4. Generally, as will be apparent from FIGS. 1 and 2, the width of these ports varies axially of the wall, but is constant in the generally radial direction through the ports. The variation in width is to cause the desired relation of area of these primary air ports with respect to movement of a slide valve means which variably obstructs and may completely close the ring of ports 32.

The downstream end of wall 27 is brazed to the reaction zone wall 7, 8, 11 within which the air and evaporated fuel combine to complete combustion of the fuel. The resulting hot combustion products flow from wall section 11 into the upstream end of the dilution zone 14 defined by the cylindrical wall section 12. The variable portion of the dilution air enters through a ring of suitably contoured ports 35 in the sheet metal wall. These ports are varied from closed to full open by a secondary air slide valve means or slide valve assembly 36, which is coupled to the slide valve assembly 34 for concurrent movement, the arrangement being such that the primary air ports are closed as the secondary air ports are opened and vice versa. Additional dilution air is introduced through a ring of fixed air ports 38 at the downstream end of the liner. The wall of the dilution section is deformed inwardly as indicated at 39 for clearance from a part of a particular engine in the particular installation.

This completes the description of the combustion liner apart from the air control means of the invention. There should be no need to explain the operation of the combustion apparatus in view of prior art disclosures of such.

Figure 5:
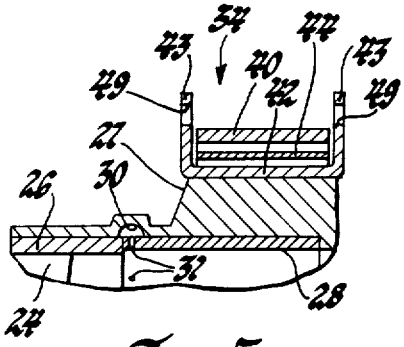
FIG. 5 is a fragmentary enlarged longitudinal sectional view taken on the plane indicated by the line 5—5 in FIG. 4.

The two movable slide valve means 34 and 36 are of essentially the same type of structure. Considering first the valve means 34 shown in FIGS. 4, and 5 in addition to FIG. 1, it comprises a rigid external actuating ring or hoop 40, preferably about 2 to 2½ millimeters in thickness, which is spaced from the exterior of wall 27. The valve assembly also includes four valve plates 42 each extending nearly 90° around the circumference. These plates are of approximately quarter-cylindrical shape so as to fit the outer surface of wall 27. Each plate 42 bears four tabs 43, one at each corner of the plate, which extend past the forward and rear edges of the ring 40 as shown clearly in the figures. These tabs have a slight clearance from the edges of ring 40 so that the plates 42 must move axially with the actuating ring 40 but can move radially relative to the ring 40.

The valve plates 42 are held resiliently in contact with the liner wall so as to permit relative expansion and minimize undesired friction while maintaining close contact. This is accomplished by a leaf spring 44 for each valve plate, each leaf spring having a slight bend or break at its center at 46 where it bears against the inside of the actuating ring 40. Each spring also has two slightly rolled end portions 47 which bear against the valve plate near its circumferential ends. The tabs 43 also confine the leaf spring 44 against slipping axially out of place.

The valve plates and leaf springs are held in position circumferentially of the ring 40 by four small blocks 48 fixed to and extending inwardly from the ring to proximity to the exterior of the liner wall. It will be seen, therefore, that the ring 40 is rather loosely guided on the liner wall but that it provides a reaction point for the springs 44 which hold the valve plates 42 which control air flow in contact with the liner wall. In the particular installation, it is contemplated that each spring exert about one-half kilogram force in the radial direction against the ring 40. The tabs 43 have holes 49 through them through which a wire or the like may be inserted to hold the valve parts together until they are in place on the liner wall.

Figure 3:
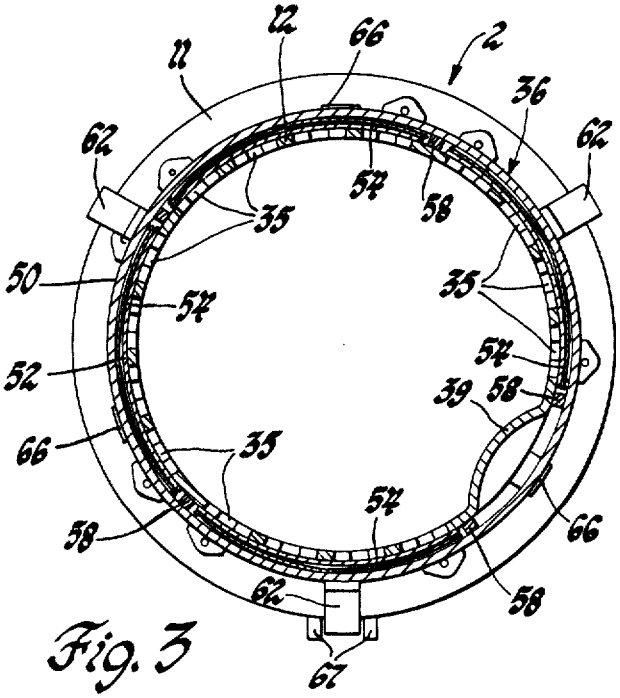
FIG. 3 is a transverse section taken on the plane indicated by the line 3—3 in FIG. 1.
Figure 6:
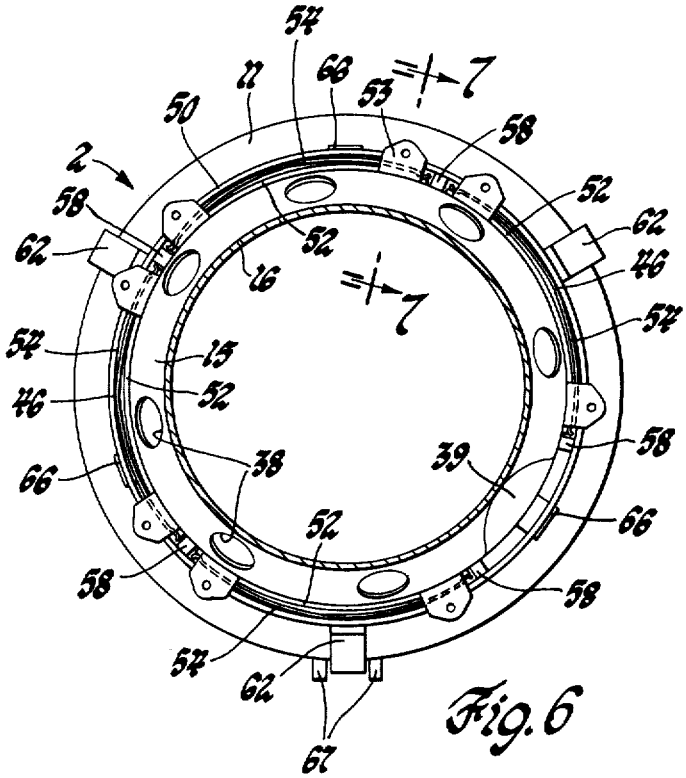
FIG. 6 is an end elevation view taken on the plane indicated by the line 6—6 in FIG. 1.
Figure 7:
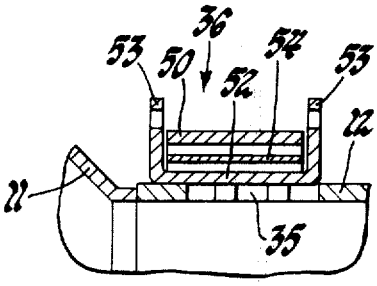
FIG. 7 is a fragmentary enlarged sectional view taken on the plane indicated by the line 7—7 in FIG. 6.

The slide valve means or assembly 36 illustrated particularly in FIGS. 3, 6, and 7 is essentially of the same construction as the assembly 34 except for dimensions and except for the adaptation to the deformation of the liner wall at 39 previously referred to.

Since the slide valve means 36 has the same parts as slide valve means 34, these parts were given the same numbers plus 10 and no further explanation should be necessary, except that it may be pointed out that the valve plates 52 are of somewhat less than 90° extent because it is desired to leave a gap between them at the location of the deformed wall portion 39. Likewise, for this reason, there are five blocks 58 on the interior of actuating ring 50 to locate the valve plates and leaf springs.

Proceeding now to the arrangement for jointly reciprocating the valve means 34 and 36, these are coupled together by three struts 62 equally spaced around the liner which are welded to both actuating rings. A gusset 63 reinforces each strut where it is bent inward at the forward end of the liner. An eye 64 at the front end of one strut provides for connection to an external actuator (not illustrated) by which the valves are moved.

Figure 2:
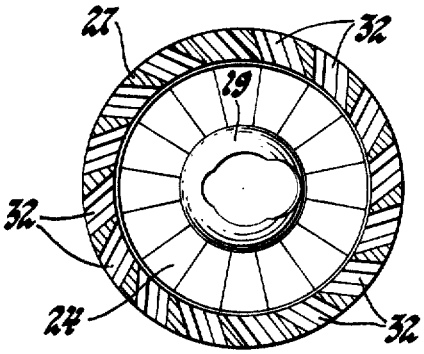
FIG. 2 is a transverse section of the liner wall taken on the plane indicated by the line 2—2 in FIG. 1.

The forward movement is limited by three stop blocks 66 spaced around and fixed to the exterior of section 12 of the liner. Two guide blocks 67 disposed on opposite sides of the lower strut 62, as illustrated in FIG. 1, serve to locate the struts circumferentially of the liner.

This completes the disclosure of the structure. As to operation, it should be clear that the valve arrangement provides for smooth, non-binding operation and provides for close contact between the valve plates and the liner wall notwithstanding different expansions of these parts under differing conditions of operation such as changes in fuel flow or warm-up of the engine, or the effect of radiation on the valve means which will vary with the position of the valve means.

The contouring of the air entrance holes 32 and 35 may embody any desired relative variation of width of the openings with respect to axial distance along the liner to suit the characteristics of a particular combustion apparatus. By contouring the slots and by taking advantage of the close clearance provided by the valve means illustrated, it is possible to obtain a very accurate relative control of primary and secondary air with a single linear input movement and to avoid using complicated cam mechanisms to cooordinate variation of an air flow with movement of such a control member as the engine power control of the gas turbine engine, for example.

It will be apparent that the type of yieldable movable valve member illustrated is usable in many environments. It is also clear that the structure such as 34 or 36 could be inside the ported wall for radially outward flow. Also, the structure could be adapted for rotation to control flow rather than reciprocation.

The detailed description of the preferred embodiment of the invention for the purpose of explaining the principles thereof is not to be considered as limiting or restricting the invention, since many modifications may be made by the exercise of skill in the art.

We claim:

1. Means for controlling flow of hot gas comprising, in combination, a substantially cylindrical body defined by a wall with ports through the wall adapted for flow of hot gas from one surface of the wall through the ports to the other surface of the wall and slide valve means movable relative to the body to vary the area of the said ports, wherein the improvement comprises slide valve means including a movable actuating ring extending around the body overlying the surface which is upstream in the direction of flow through the ports; a circumferential row of part-cylindrical valve plates disposed between the actuating ring and the body configured to slide on the surface of the body to throttle the said ports variably; means coupling the valve plates to the actuating ring for concurrent movement; and spring means mounted between the actuating ring and the valve plates reacting against the ring and the plates to press the plates against the body.

2. Means for controlling flow of hot gas comprising, in combination, a substantially cylindrical body defined by a wall with ports through the wall adapted for flow of hot gas from one surface of the wall through the ports to the other surface of the wall and slide valve means movable axially of the body to vary the area of the said ports, wherein the improvement comprises slide valve means including a movable actuating ring extending around the body overlying the surface which is upstream in the direction of flow through the ports; a circumferential row of part-cylindrical valve plates disposed between the actuating ring and the body configured to slide axially on the surface of the body to throttle the said ports variably; means coupling the valve plates to the actuating ring for concurrent movement; and leaf spring means mounted between the actuating ring and the valve plates reacting against the ring and the plates to press the plates against the body.

3. Means for controlling flow of hot gas comprising, in combination, a substantially cylindrical body defined by a wall with ports through the wall adapted for flow of hot gas from the outer surface of the wall through the ports to the inner surface of the wall and slide valve means movable axially of the body to vary the area of the said ports, wherein the improvement comprises slide valve means including a movable actuating ring extending around the body overlying the surface which is upstream in the direction of flow through the ports; a circumferential row of part-cylindrical valve plates disposed between the actuating ring and the body configured to slide axially on the surface of the body to throttle the said ports variably; means coupling the valve plates to the actuating ring for concurrent movement; and leaf spring means mounted between the actuating ring and the valve plates reacting against the ring and the plates to press the plates against the body.

4. Means for controlling flow of hot gas comprising, in combination, a substantially cylindrical body defined by a wall with ports through the wall adapted for flow of hot gas from one surface of the wall through the ports to the other surface of the wall and slide valve means movable axially of the body to vary the area of the said ports, wherein the improvement comprises slide valve means including a movable actuating ring extending around the body overlying the surface which is upstream in the direction of flow through the ports; a circumferential row of part-cylindrical valve plates disposed between the actuating ring and the body configured to slide on the surface of the body to throttle the said ports variably; tabs extending from the valve plates past the edges of the actuating ring coupling the valve plates to the actuating ring for concurrent movement; and leaf spring means mounted between the actuating ring and the valve plates reacting against the ring and the plates to press the plates against the body; the tab means having holes for receiving a wire or the like to hold the parts assembled prior to disposition of slide valve means on the body.

5. Means for controlling flow of hot gas comprising, in combination, a substantially cylindrical flame tube body defined by a wall with two sets of ports through the wall adapted for flow of hot air from the outer surface of the wall through the ports to the inner surface of the wall and slide valve means movable axially of the body to vary reversely the area of the said sets of ports, wherein the improvement comprises slide valve means for each set of ports, each including a movable actuating ring extending around the body overlying the outer surface of the body; a circumferential row of part-cylindrical valve plates disposed between the actuating ring and the body configured to slide on the surface of the body to throttle the said ports variably; means coupling the valve plates to the actuating ring for concurrent movement; spring means mounted between the actuating ring and the valve plates reacting against the ring and the plates to press the plates against the body; and means coupling the two actuating rings together for concurrent movement.

* * * * *